US008805680B2

(12) United States Patent
Lee et al.

(10) Patent No.: US 8,805,680 B2
(45) Date of Patent: Aug. 12, 2014

(54) METHOD AND APPARATUS FOR ENCODING AND DECODING AUDIO SIGNAL USING LAYERED SINUSOIDAL PULSE CODING

(75) Inventors: Mi-Suk Lee, Daejeon (KR); Heesik Yang, Gyeongsangnam-do (KR); Hyun-Woo Kim, Daejeon (KR); Jongmo Sung, Daejeon (KR); Hyun-Joo Bae, Daejeon (KR); Byung-Sun Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 119 days.

(21) Appl. No.: 13/321,297

(22) PCT Filed: May 19, 2010

(86) PCT No.: PCT/KR2010/003167

§ 371 (c)(1),
(2), (4) Date: Dec. 12, 2011

(87) PCT Pub. No.: WO2010/134757

PCT Pub. Date: Nov. 25, 2010

(65) Prior Publication Data

US 2012/0095754 A1 Apr. 19, 2012

(30) Foreign Application Priority Data

May 19, 2009 (KR) ..... 10-2009-0043475
Sep. 29, 2009 (KR) ..... 10-2009-0092701

(51) Int. Cl.
*G10L 19/02* (2013.01)

(52) U.S. Cl.
USPC ..... 704/203; 704/501; 704/500; 704/230; 704/223; 704/222; 704/219; 704/207; 704/201; 702/190; 455/66.1; 381/57; 375/371; 375/320; 375/350; 375/328

(58) Field of Classification Search
USPC ..... 704/500, 203, 501, 230, 223, 219, 207, 704/201; 702/190; 455/66.1; 381/57; 375/371, 320, 350, 328
See application file for complete search history.

(56) References Cited

U.S. PATENT DOCUMENTS 5,812,737 A * 9/1998 Wang ..... 704/207
6,980,933 B2 * 12/2005 Cheng et al. ..... 702/190

(Continued)

FOREIGN PATENT DOCUMENTS

JP 07-168593 7/1995
KR 10-2004-0108638 12/2004

(Continued)

OTHER PUBLICATIONS

Scott N. Levin et al., "Multiresolution Sinusoidal Modeling for Wideband Audio with Modifications", Acoustics, Speech and Signal Processing, 1998. Proceedings of the 1998 IEEE International Conference on, vol. 6, pp. 3585-3588, May 2, 1998.
H.W. Kim et al., "The trend of G.729.1 wideband multi-codec technology", ETRI's Electronics and Telecommunications Trends, vol. 21, No. 6, pp. 77-85, Dec. 2006.

(Continued)

*Primary Examiner* — Michael Colucci
(74) *Attorney, Agent, or Firm* — Staas & Halsey LLP

(57) ABSTRACT

Provided are a method and an apparatus for encoding and decoding an audio signal. A method for encoding an audio signal includes receiving a transformed audio signal, dividing the transformed audio signal into a plurality of subbands, performing a first sinusoidal pulse coding operation on the subbands, determining a performance region of a second sinusoidal pulse coding operation among the subbands on the basis of coding information of the first sinusoidal pulse coding operation, and performing the second sinusoidal pulse coding operation on the determined performance region, wherein the first sinusoidal pulse coding operation is performed variably according to the coding information. Accordingly, it is possible to further improve the quality of a synthesized signal by considering the sinusoidal pulse coding of a lower layer when encoding or decoding an audio signal in an upper layer by a layered sinusoidal pulse coding scheme.

12 Claims, 9 Drawing Sheets

(56) References Cited

U.S. PATENT DOCUMENTS

| | | | | |
|---|---|---|---|---|
| 7,697,650 | B2 * | 4/2010 | Haddad et al. | 375/371 |
| 7,953,605 | B2 * | 5/2011 | Sinha et al. | 704/501 |
| RE42,935 | E * | 11/2011 | Cheng et al. | 702/190 |
| 8,144,882 | B2 * | 3/2012 | Christoph et al. | 381/57 |
| 2004/0161116 | A1 | 8/2004 | Tsuji et al. | |
| 2006/0277040 | A1 | 12/2006 | Sung et al. | |
| 2006/0277042 | A1 * | 12/2006 | Vos et al. | 704/223 |
| 2007/0002973 | A1 * | 1/2007 | Kluesing et al. | 375/320 |
| 2007/0027678 | A1 * | 2/2007 | Hotho et al. | 704/203 |
| 2007/0106505 | A1 * | 5/2007 | Gerrits et al. | 704/230 |
| 2007/0174053 | A1 * | 7/2007 | You | 704/222 |
| 2007/0238415 | A1 * | 10/2007 | Sinha et al. | 455/66.1 |
| 2008/0027711 | A1 * | 1/2008 | Rajendran et al. | 704/201 |
| 2008/0228471 | A1 * | 9/2008 | Cabot et al. | 704/203 |
| 2008/0312914 | A1 * | 12/2008 | Rajendran et al. | 704/207 |
| 2009/0024396 | A1 * | 1/2009 | Lee et al. | 704/500 |
| 2009/0240491 | A1 * | 9/2009 | Reznik | 704/219 |
| 2009/0271204 | A1 * | 10/2009 | Tammi | 704/500 |
| 2010/0250261 | A1 * | 9/2010 | Laaksonen et al. | 704/500 |
| 2011/0142030 | A1 * | 6/2011 | Pietsch et al. | 370/350 |
| 2011/0149847 | A1 * | 6/2011 | Pietsch et al. | 370/328 |
| 2011/0178807 | A1 * | 7/2011 | Yang et al. | 704/500 |
| 2011/0301961 | A1 * | 12/2011 | Lee et al. | 704/500 |

FOREIGN PATENT DOCUMENTS

| | | |
|---|---|---|
| KR | 10-2006-0124568 | 12/2006 |
| WO | WO 2009/011483 | 1/2009 |
| WO | WO 2009/059633 | 5/2009 |

OTHER PUBLICATIONS

Balázs Kövesi et al., "A Scalable Speech and Audio Coding Scheme with Continuous Bitrate Flexibility", ICASSP 2004, pp. 273-276, 2004.

"G.729-based Embedded Variable Bit-Rate Coder: An 8-32 kbit/s Scalable Wideband Coder Bitstream Interoperable with G. 729", ITU-T, Mar. 28, 2010.

"Frame Error Robust Narrow-Band and Wideband Embedded Variable Bit-Rate Coding of Speech and Audio from 8-32 kbit/s", ITU-T, Mar. 28, 2010.

International Search Report issued Dec. 29, 2010 in corresponding PCT Application No. PCT/KR2010/003167.

Mikko Tammi et al., "Scalable Superwideband Extension for Wideband Coding" Acoustics, Speech and Signal Processing, 2009. IEEE International Conference on, IEEE, Piscatway, NJ, USA, Apr. 19, 2009, pp. 161-164, XP31459191.

Editor G 718-SWB et al., "Draft new G.718(2008) Amendment 2 Frame error robust narrowband and wideband embedded variable bit-rate coding of speech and audio from 8-32 kbit/s: New Annex B on superwideband scalable extension for G.718 and corrections to main bod fixed-point C-code and description text (for Censent)", ITU-T SG16 Meeting; Oct. 26, 2009-Nov. 6, 2009; Geneva, To. T09-SG16-091026-TD-WP3-0104, Nov. 4, 2009, XP030100078, pp. 2.

729 1 SWB Editor G: "Draft new G.729.1 (2006) Amendment 6 (ex G.729.1-SWB) G.729-based embedded variable bit-rate coder: An 8-32 kbit/s scalable wideband coder bitstream interoperable with G.729:New Annex E on superwideband scalable extension for G.729.1 (for Consent)", ITU-T SG16 Meeting;Oct. 26, 2009-Nov. 6, 2009; Geneva, No. T09-SG16-091026-TD-WP3-0105, Nov. 4, 2009, XP030100077, pp. 2.

* cited by examiner

METHOD AND APPARATUS FOR ENCODING AND DECODING AUDIO SIGNAL USING LAYERED SINUSOIDAL PULSE CODING

CROSS REFERENCE TO RELATED APPLICATIONS

This application claims the benefit under 35 U.S.C. Section 371, of PCT International Application Number PCT/KR2010/003167, filed May 19, 2010, which claims priority benefit of Korean Application No. 10-2009-0043475, filed May 19, 2009 and Korean Application No. 10-2009-0092701, filed Sep. 29, 2009, of which the contents of which are incorporated herein by reference.

TECHNICAL FIELD

Exemplary embodiments of the present invention relate to a method and apparatus for encoding and decoding an audio signal; and, more particularly, to a method and apparatus for encoding and decoding an audio signal by a layered sinusoidal pulse coding scheme.

BACKGROUND ART

As the data transmission bandwidth increases with the development of communication technology, users' demand for high-quality communication services using multi-channel voice and audio increases. A coding scheme capable of effectively compressing and decompressing stereo voice and audio signals is necessary to provide high-quality voice/audio communication services.

Accordingly, extensive research is being conducted on a codec for coding narrowband (NB, 300~3,400 Hz) signals, wideband (WB, 50~7,000 Hz) signals, and super-wideband (SWB, 50~14,000 Hz) signals. An ITU-T G.729.1 codec is a typical example of a wideband extension codec based on a G.729 narrowband codec. The ITU-T G.729.1 wideband extension codec provides a bitstream-level compatibility with the G.729 narrowband codec at 8 kbit/s, and provides narrowband signals of improved quality at 12 kbit/s. Also, the ITU-T G.729.1 wideband extension codec can encode wideband signals with a bit-rate extensibility of 2 kbit/s from 14 kbit/s to 32 kbit/s, and can improves the quality of an output signal with an increase in the bit rate.

Recently, an extension codec capable of providing super-wideband signals based on G.729.1 is being developed. This extension codec can encode and decode narrowband, wideband and super-wideband signals.

The extension codec may use sinusoidal pulse coding to improve the quality of a synthesized signal. The sinusoidal pulse coding may be performed through a plurality of layers. If the number of pulses or bits allocated for sinusoidal pulse coding by a lower layer varies on a frame-by-frame basis, it is necessary to provide a scheme for improving the quality of a synthesized signal in sinusoidal pulse coding by an upper layer.

DISCLOSURE

Technical Problem

An embodiment of the present invention is directed to a method and apparatus for encoding and decoding an audio signal, which can further improve the quality of a synthesized signal by considering the sinusoidal pulse coding of a lower layer when encoding or decoding an audio signal in an upper layer by a layered sinusoidal pulse coding scheme.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

Technical Solution

In accordance with an embodiment of the present invention, a method for encoding an audio signal includes: receiving a transformed audio signal; dividing the transformed audio signal into a plurality of subbands; performing a first sinusoidal pulse coding operation on the subbands; determining a performance region of a second sinusoidal pulse coding operation among the subbands on the basis of coding information of the first sinusoidal pulse coding operation; and performing the second sinusoidal pulse coding operation on the determined performance region, wherein the first sinusoidal pulse coding operation is performed variably according to the coding information.

In accordance with another embodiment of the present invention, an apparatus for encoding an audio signal includes: an input unit configured to receive a transformed audio signal; an operation unit configured to divide the transformed audio signal into a plurality of subbands; a first sinusoidal pulse coding unit configured to perform a first sinusoidal pulse coding operation on the subbands; and a second sinusoidal pulse coding unit configured to determine a performance region of a second sinusoidal pulse coding operation among the subbands on the basis of coding information of the first sinusoidal pulse coding operation, and perform the second sinusoidal pulse coding operation on the determined performance region, wherein the first sinusoidal pulse coding unit performs the first sinusoidal pulse coding operation variably according to the coding information.

In accordance with another embodiment of the present invention, a method for decoding an audio signal includes: receiving a transformed audio signal; dividing the transformed audio signal into a plurality of subbands; performing a first sinusoidal pulse decoding operation on the subbands; determining a performance region of a second sinusoidal pulse decoding operation among the subbands on the basis of decoding information of the first sinusoidal pulse decoding operation; and performing the second sinusoidal pulse decoding operation on the determined performance region, wherein the first sinusoidal pulse decoding operation is performed variably according to the decoding information.

In accordance with another embodiment of the present invention, an apparatus for decoding an audio signal includes: an input unit configured to receive a transformed audio signal; an operation unit configured to divide the transformed audio signal into a plurality of subbands; a first sinusoidal pulse decoding unit configured to perform a first sinusoidal pulse decoding operation on the subbands; and a second sinusoidal pulse decoding unit configured to determine a performance region of a second sinusoidal pulse decoding operation among the subbands on the basis of decoding information of the first sinusoidal pulse decoding operation, and perform the second sinusoidal pulse decoding operation on the determined performance region, wherein the first sinusoidal pulse decoding unit performs the first sinusoidal pulse decoding operation variably according to the decoding information.

Advantageous Effects

As described above, the present invention can further improve the quality of a synthesized signal by considering the sinusoidal pulse coding of a lower layer when encoding or decoding an audio signal in an upper layer by a layered sinusoidal pulse coding scheme.

BEST MODE

Figure 1:
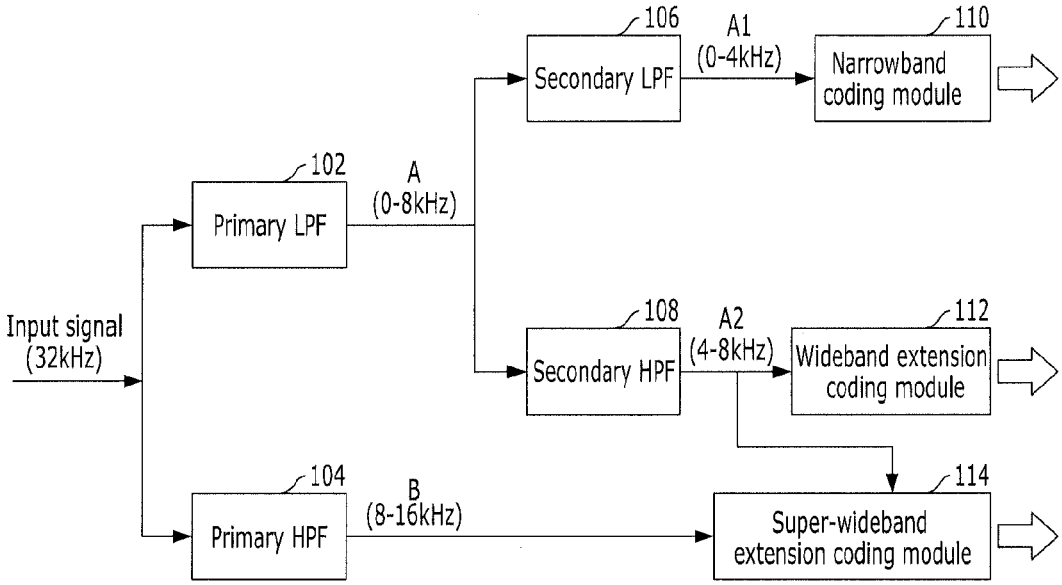
FIG. 1 is a block diagram of a super-wideband (SWB) extension codec providing compatibility with a narrowband (NB) codec.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

FIG. 1 is a block diagram of a super-wideband (SWB) extension codec providing compatibility with a narrowband (NB) codec.

In general, an extension codec is configured to divide an input signal into a plurality of frequency bands and encode/decode a signal of each frequency band. Referring to FIG. 1, an input signal is filtered by a primary low-pass filter (LPF) 102 and a primary high-pass filter (HPF) 104. The primary LPF 102 performs filtering and down-sampling to output a low-frequency signal A (0-8 kHz) of the input signal. The primary HPF 104 performs filtering and down-sampling to output a high-frequency signal B (8-16 kHz) of the input signal.

The low-frequency signal A outputted from the primary LPF 102 is inputted to a secondary LPF 106 and a secondary HPF 108. The secondary LPF 106 performs filtering and down-sampling to output a low-low-frequency signal A1 (0-4 kHz), and the secondary HPF 108 performs filtering and down-sampling to output a low-high-frequency signal A2 (4-8 kHz).

The low-low-frequency signal A1 is inputted to a narrowband coding module 110. The low-high-frequency signal A2 is inputted to a wideband extension coding module 112. The high-frequency signal B is inputted to a super-wideband coding module 114. If the narrowband coding module 110 is operated, only a narrowband signal is reproduced. If the narrowband coding module 110 and the wideband extension coding module 112 are operated, a wideband signal is reproduced. If the narrowband coding module 110, the wideband extension coding module 112 and the super-wideband extension coding module 114 are operated, a super-wideband signal is reproduced.

An ITU-T G.729.1 codec is a typical example of the extension codec illustrated in FIG. 1. The ITU-T G.729.1 codec is a wideband extension codec based on a G.729 narrowband codec. The G.729.1 codec provides a bitstream-level compatibility with the G.729 at 8 kbit/s, and provides a narrowband signal with a higher quality at 12 kbit/s. Also, the G.729.1 codec reproduces a wideband signal with a 2 kbit/s bit rate extensibility from 14 kbit/s to 32 kbit/s, and the quality of an output signal improves with an increase in the bit rate.

Recently, an extension codec capable of providing a super-wideband quality based on G.729.1 is being developed. This extension codec can encode and decode narrowband, wideband and super-wideband signals.

In such an extension codec, different coding schemes may be applied according to frequencies bands as illustrated in FIG. 1. For example, the G.729.1 and G.711.1 codecs encode narrowband signals by the conventional narrowband codecs G. 729 and G. 711, perform a modified discrete cosine transform (MDCT) operation on the remaining signals, and encode the outputted MDCT coefficients.

An MDCT domain coding scheme divides MDCT coefficients into a plurality of subbands, encodes the shape and gain of each subband, and encodes MDCT coefficients by ACELP (Algebraic Code-Excited Linear Prediction) or sinusoidal pulses. In general, the extension codec encodes information for bandwidth extension and then encodes information for quality improvement. For example, the extension codec synthesizes signals of a 7-14 kHz band by using the shape and gain of each subband, and then improves the quality of a synthesized signal by using an ACELP or sinusoidal pulse coding scheme.

That is, the first layer providing super-wideband quality synthesizes signals corresponding to a 7-14 kHz band by using information such as the shape and gain of each subband. Additional bits are used to apply a sinusoidal pulse coding operation for improvement of the quality of a synthesized signal. This structure makes it possible to improve the quality of a synthesized signal according to an increase in the bit rate.

In general, the sinusoidal pulse coding scheme encodes the code information, size and position of the largest pulse in a predetermined step (i.e., the pulse that may exert the greatest influence on the quality). As the width of the pulse search step increases, the calculation amount increases. Accordingly, performing a sinusoidal pulse coding operation on a subframe-by-subframe basis or on a subband-by-subband basis is preferable to performing a sinusoidal pulse coding operation on the entire frame (in the case of the time domain) or on the entire frequency band. The sinusoidal pulse coding scheme needs more bits to transmit one pulse, but can more accurately represent a signal that affects the signal quality.

Input signals of the codec have various energy distributions depending on frequencies. In particular, a music signal has a larger frequency-dependent energy change than a voice signal. A higher-energy subband signal exerts a greater influence on the quality of a synthesized signal.

A layered sinusoidal pulse coding scheme may be used to perform a sinusoidal pulse coding operation on a subband-by-subband basis. The layered sinusoidal pulse coding scheme performs a sinusoidal pulse coding operation through a plurality of layers. For example, the first layer performs a sinusoidal pulse coding operation on the first region of the entire subband, and the second layer performs a sinusoidal pulse coding operation on the second region of the entire subband. It is possible to improve the quality of an audio signal, by considering the energy or frequency band of a signal as described above, when performing a layered sinusoidal pulse coding operation.

The present invention provides an audio signal encoding/decoding scheme that can further improve the quality of a synthesized signal by performing a sinusoidal pulse coding operation on the next layer on the basis of the coding information of the previous layer when performing a layered sinusoidal pulse coding operation in the extension codec of FIG. 1. In the following description of the present invention, voice and audio signals will be referred to as audio signals.

Figure 2:
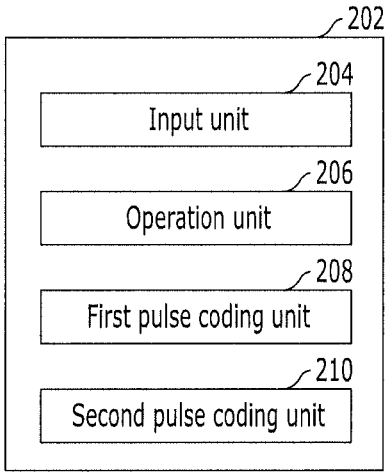
FIG. 2 is a block diagram of an audio signal encoding apparatus in accordance with an embodiment of the present invention.

FIG. 2 is a block diagram of an audio signal encoding apparatus in accordance with an embodiment of the present invention.

Referring to FIG. 2, an audio signal encoding apparatus 202 includes an input unit 204, an operation unit 206, a first sinusoidal pulse coding unit 208, and a second sinusoidal pulse coding unit 210.

The input unit 204 receives a transformed audio signal, for example an MDCT coefficient that is transformed by MDCT from an audio signal.

The operation unit 206 divides the transformed audio signal, received through the input unit 204, into a plurality of subbands.

The first sinusoidal pulse coding unit 208 performs a first sinusoidal pulse coding operation on the subbands divided by the operation unit 206. The first sinusoidal pulse coding unit 208 performs the first sinusoidal pulse coding operation variably according to coding information. Herein, the coding information may be information about the number of bits allocated for the first sinusoidal pulse coding operation, or information about the number of pulses allocated for the first sinusoidal pulse coding operation. Also, performing the first sinusoidal pulse coding operation variably may mean performing the first sinusoidal pulse coding operation while varying the number of bits or the number of pulses, or may mean performing the first sinusoidal pulse coding operation in the order of the energy of each subband, not in the order of the frequency band.

The second sinusoidal pulse coding unit 210 determines a performance region of a second sinusoidal pulse coding operation among the subbands on the basis of coding information of the first sinusoidal pulse coding operation. In an exemplary embodiment, the second sinusoidal pulse coding unit 210 determines a lower band of the subbands as the performance region of the second sinusoidal pulse coding operation if the coding information is smaller than a predetermined value, and determines an upper band of the subbands as the performance region of the second sinusoidal pulse coding operation if the coding information is greater than or equal to the predetermined value. In another exemplary embodiment, the second sinusoidal pulse coding unit 210 starts applying the second sinusoidal pulse coding operation, from the lowest frequency band to which the first sinusoidal pulse coding operation is not applied. The second sinusoidal pulse coding unit 210 performs the second sinusoidal pulse coding operation on the determined performance region.

Figure 3:
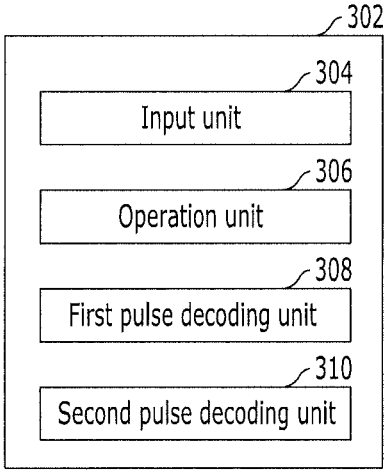
FIG. 3 is a block diagram of an audio signal decoding apparatus in accordance with an embodiment of the present invention.

FIG. 3 is a block diagram of an audio signal decoding apparatus in accordance with an embodiment of the present invention.

Referring to FIG. 3, an audio signal decoding apparatus 302 includes an input unit 304, an operation unit 306, a first sinusoidal pulse decoding unit 308, and a second sinusoidal pulse decoding unit 310.

The input unit 304 receives a transformed audio signal, for example an MDCT coefficient that is transformed by MDCT from an audio signal.

The operation unit 306 divides the transformed audio signal, received through the input unit 304, into a plurality of subbands.

The first sinusoidal pulse decoding unit 308 performs a first sinusoidal pulse decoding operation on the subbands divided by the operation unit 306. The first sinusoidal pulse decoding unit 308 performs the first sinusoidal pulse decoding operation variably according to decoding information. Herein, the decoding information may be information about the number of bits allocated for the first sinusoidal pulse decoding operation, or information about the number of pulses allocated for the first sinusoidal pulse decoding operation. Also, performing the first sinusoidal pulse decoding operation variably may mean performing the first sinusoidal pulse decoding operation while varying the number of bits or the number of pulses, or may mean performing the first sinusoidal pulse decoding operation in the order of the energy of each subband, not in the order of the frequency band.

The second sinusoidal pulse decoding unit 310 determines a performance region of a second sinusoidal pulse decoding operation among the subbands on the basis of decoding information of the first sinusoidal pulse decoding operation. In an exemplary embodiment, the second sinusoidal pulse decoding unit 310 determines a lower band of the subbands as the performance region of the second sinusoidal pulse decoding operation if the decoding information is smaller than a predetermined value, and determines an upper band of the subbands as the performance region of the second sinusoidal pulse decoding operation if the decoding information is greater than or equal to the predetermined value. In another exemplary embodiment, the second sinusoidal pulse decoding unit 310 starts applying the second sinusoidal pulse decoding operation, from the lowest frequency band to which the first sinusoidal pulse decoding operation is not applied. The second sinusoidal pulse decoding unit 310 performs the second sinusoidal pulse decoding operation on the determined performance region.

The audio signal encoding apparatus 202 and the audio signal decoding apparatus 302 illustrated in FIGS. 2 and 3 may be included in the narrowband coding module 110, the wideband extension coding module 112 or the super-wideband extension coding module 114 illustrated in FIG. 1.

Hereinafter, an audio signal encoding/decoding method in accordance with an embodiment of the present invention will be described with reference to FIGS. 1 to 8.

The super-wideband extension coding module 114 divides MDCT coefficients corresponding to 7-14 kHz into a plurality of subbands and encodes/decodes the shape and gain of each subband to obtain an error signal. The super-wideband extension coding module 114 performs a sinusoidal pulse coding/decoding operation on the error signal. Herein, it is assumed that the sinusoidal pulse coding has a layered structure capable of controlling a bit rate by the unit of 4 kbit/s or 8 kbit/s.

The super-wideband extension coding module 114 transforms a high-frequency (7-14 kHz) signal into an MDCT domain, and encodes an MDCT coefficient by a layered sinusoidal pulse coding scheme. That is, the super-wideband extension coding module 114 divides the MDCT coefficient into a plurality of subbands, and encodes two pulses for each subband. Herein, it is assumed that the first layer may encode up to 10 pulses according to frames and the second layer may encode 10 pulses in a fixed manner. That is, the number of pulses in the first layer varies from 0 to 10. If the range of one subband is 0.8 kHz (=32 samples) and if a start point of the subband is determined, 32 samples therefrom become one subband.

Figure 4:
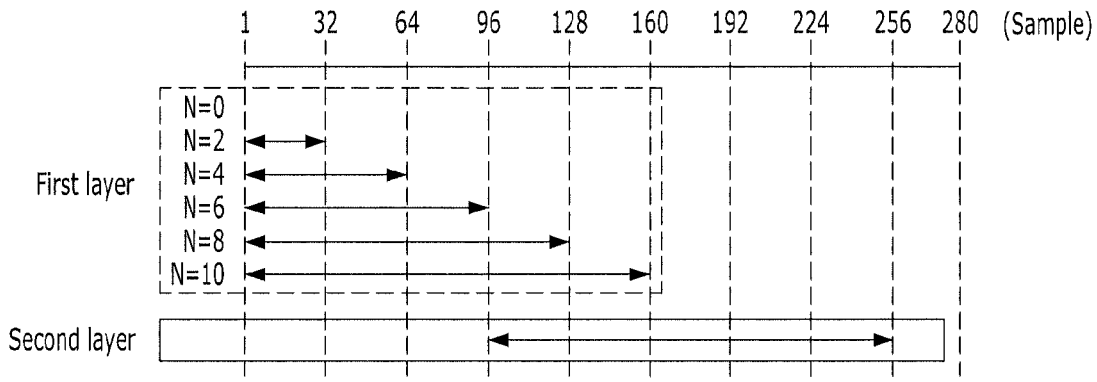
FIG. 4 illustrates the result of applying sinusoidal pulse coding to 211 MDCT coefficients corresponding to 7-14 kHz through two layers.

FIG. 4 illustrates the result of applying sinusoidal pulse coding to 211 MDCT coefficients corresponding to 7-14 kHz through two layers.

In FIG. 4, N represents the number of pulses used to perform sinusoidal pulse coding in the first layer. Referring to FIG. 4, the first layer may not perform sinusoidal pulse coding (N=0), or may perform sinusoidal pulse coding by using up to 10 pulses (N=10). Because two pulses are allocated for each subband, the number of subbands for sinusoidal pulse coding varies according to the number of pulses used to perform sinusoidal pulse coding (i.e., N). If N=2, sinusoidal pulse coding is applied to only one subband. If N=10, sinusoidal pulse coding is applied to five subbands as illustrated in FIG. 4.

In FIG. 4, the second layer always applies sinusoidal pulse coding to the same range of subbands, independent of the first layer. That is, the second layer always starts sinusoidal pulse coding from 9.4 kHz (=96 samples), independent of the sinusoidal pulse coding in the first layer.

When performing sinusoidal pulse coding as illustrated in FIG. 4, if N=6 in the first layer, after sinusoidal pulse coding of the second layer is performed, sinusoidal pulse coding is applied to the entire band of 7-13.4 kHz. However, if N=2 in the first layer, after sinusoidal pulse coding of the second layer is performed, sinusoidal pulse coding cannot be applied to a 7.8-9.4 kHz band, thus degrading the quality of a synthesized signal.

Regarding the energy distribution of an audio signal (especially a voice signal), the energy of a voiced sound is located in a lower frequency band, and the energy of a voiceless sound or a plosive sound is located in a higher frequency band. Although it may differ according to signal characteristics, most audio signals have much energy at 10 kHz or less. That is, as illustrated in FIG. 4, if the sinusoidal pulse coding of the second layer is performed independent of the sinusoidal pulse coding of the first layer, the sinusoidal pulse coding is not applied to some band (especially the band not affecting the voice quality), thus degrading the quality of a synthesized signal.

In order to solve the above problems, the present invention provides an audio signal encoding/decoding method for improving the quality of a synthesized signal by performing a sinusoidal pulse coding operation on the second layer on the basis of the coding information of a sinusoidal pulse coding operation on the first layer.

Figure 5:
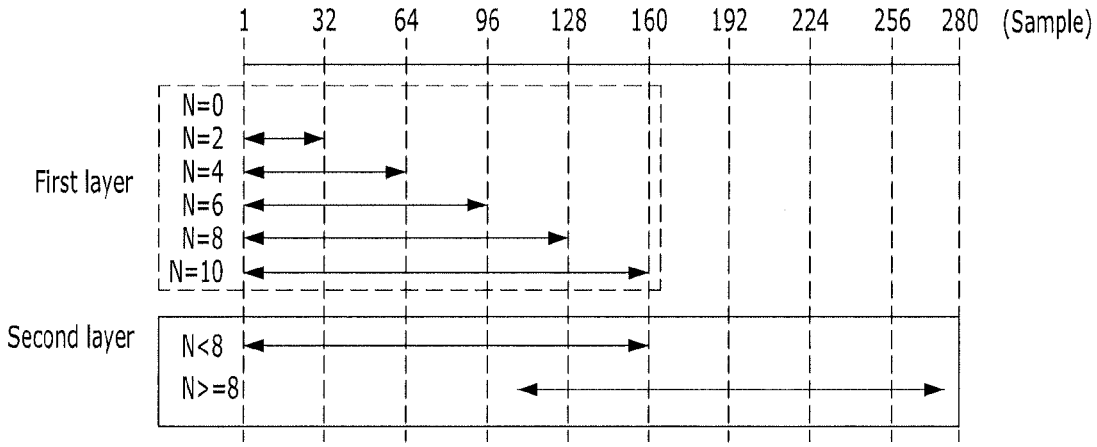
FIG. 5 illustrates the result of layered sinusoidal pulse coding in accordance with an embodiment of the present invention.

FIG. 5 illustrates the result of layered sinusoidal pulse coding in accordance with an embodiment of the present invention.

Referring to FIG. 5, the operation unit 204 of FIG. 2 receives MDCT coefficients. The operation unit 206 divides the received MDCT coefficients into a plurality of subbands as illustrated in FIG. 5. Herein, each subband has 32 samples.

The first sinusoidal pulse coding unit 208 performs a first sinusoidal pulse coding operation on the first layer. Herein, the first sinusoidal pulse coding unit 208 performs the first sinusoidal pulse coding operation variably according to coding information. The coding information may be information about the number of bits allocated for the first sinusoidal pulse coding operation, or information about the number of pulses allocated for the first sinusoidal pulse coding operation. If four sinusoidal pulses (or the corresponding bits) are allocated for the first sinusoidal pulse coding operation, the first sinusoidal pulse coding unit 208 uses such information to perform a first sinusoidal pulse coding operation on two subbands (N=4).

The second sinusoidal pulse coding unit 210 uses the above coding information to determine a performance region of a sinusoidal pulse coding operation among the subbands. The second sinusoidal pulse coding unit 210 may receive the coding information, which includes information about the number of bits allocated for the first sinusoidal pulse coding operation, information about the number of pulses allocated, and information about the code, size and position of each pulse, from the first sinusoidal pulse coding unit 208. Referring to FIG. 5, if N is smaller than 8, the second sinusoidal pulse coding unit 210 performs a second sinusoidal pulse coding operation on a lower band (7-11 kHz). If N is greater than or equal to 8, the second sinusoidal pulse coding unit 210 performs a second sinusoidal pulse coding operation on a higher band (9.75-13.75 kHz).

Performing such a layered sinusoidal pulse coding operation can solve the problems of the conventional coding method. For example, if N=6 in the first layer, the second layer performs a sinusoidal pulse coding operation on the lower layer as illustrated in FIG. 5, thus making it possible to improve the quality of an audio signal that has most energy at 10 kHz or less.

Figure 6:
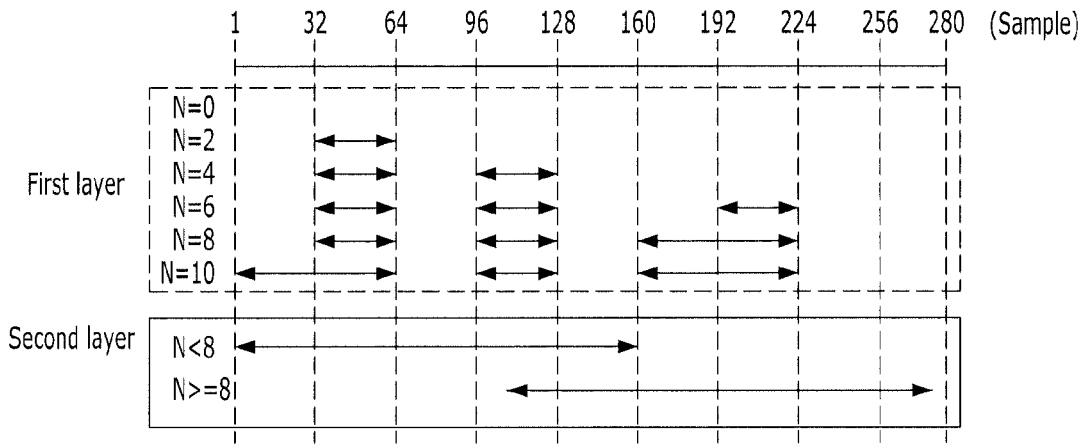
FIG. 6 illustrates the result of layered sinusoidal pulse coding in accordance with another embodiment of the present invention.

FIG. 6 illustrates the result of layered sinusoidal pulse coding in accordance with another embodiment of the present invention.

The second sinusoidal pulse coding unit 210 of this embodiment performs a second sinusoidal pulse coding operation like the second sinusoidal pulse coding unit 210 described with reference to FIG. 5. However, the first sinusoidal pulse coding unit 208 of this embodiment performs a sinusoidal pulse coding operation variably in the order of the energy of the subbands, not in the order of the frequency band.

Figure 7:
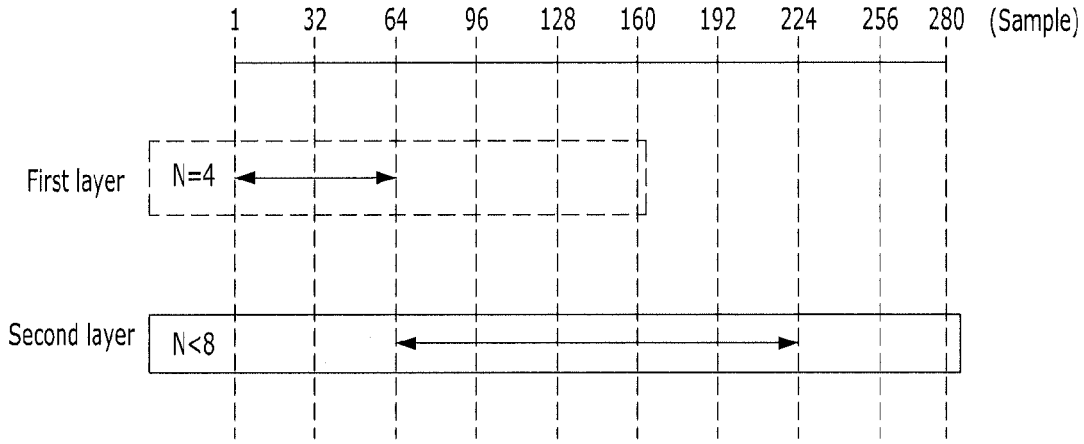
FIG. 7 illustrates the result of layered sinusoidal pulse coding in accordance with another embodiment of the present invention.

FIG. 7 illustrates the result of layered sinusoidal pulse coding in accordance with another embodiment of the present invention.

The first sinusoidal pulse coding unit 208 of this embodiment performs a first sinusoidal pulse coding operation like the embodiment of FIG. 4. The second sinusoidal pulse coding unit 210 performs a second sinusoidal pulse coding operation on the basis of coding information including information about the lowest frequency band to which the first sinusoidal pulse coding operation is not performed in the first layer. For example, if N=4 as illustrated in FIG. 7, the second sinusoidal pulse coding unit 210 starts sinusoidal pulse coding from the subband corresponding to the $64^{th}$ sample.

The above-described embodiments of the present invention may be similarly applicable to decoding, as well as to encoding.

Figure 8:
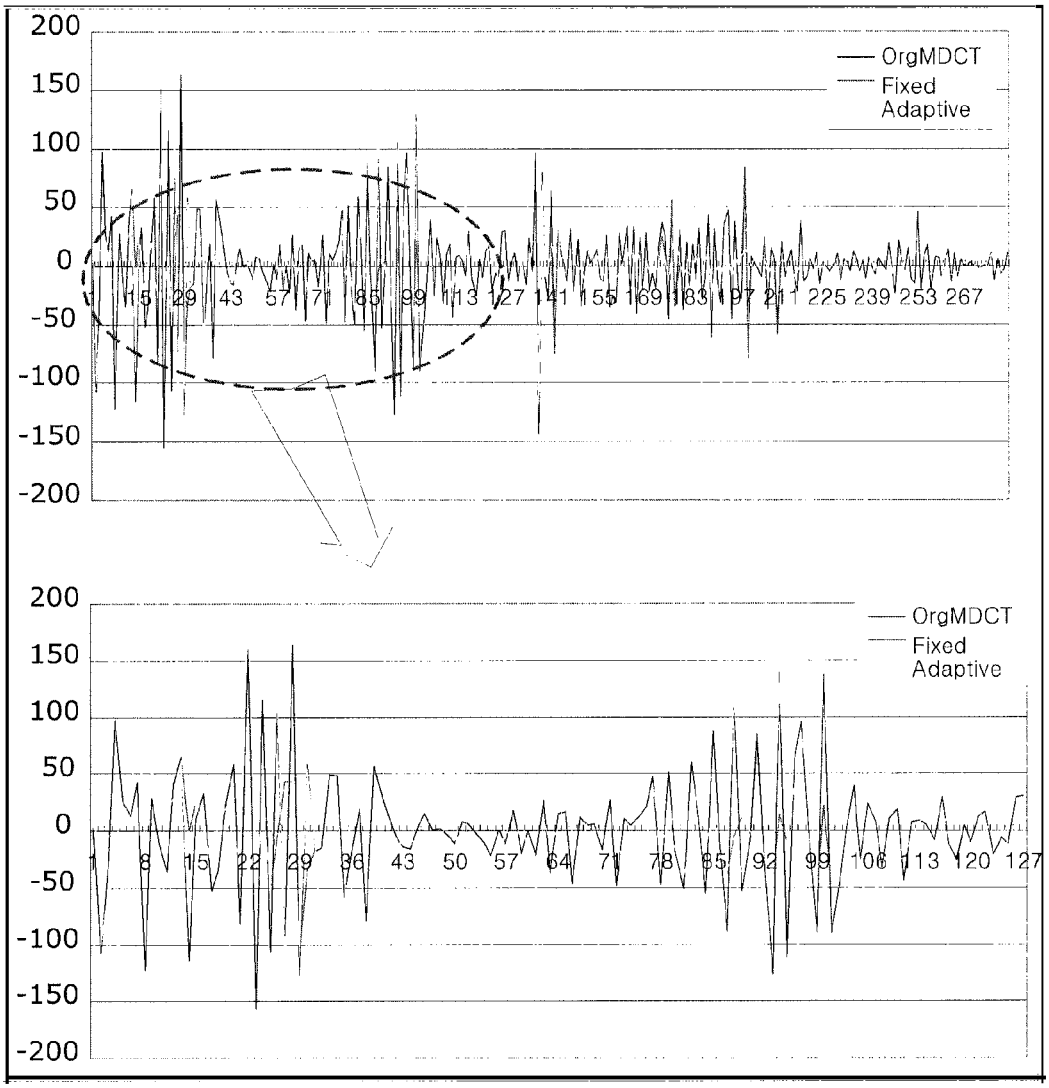
FIG. 8 is a graph illustrating MDCT coefficients synthesized by a conventional sinusoidal pulse coding method and MDCT coefficients synthesized by a sinusoidal pulse coding method of the present invention.

FIG. 8 is a graph illustrating MDCT coefficients synthesized by a conventional sinusoidal pulse coding method and MDCT coefficients synthesized by a sinusoidal pulse coding method of the present invention.

In FIG. 8, a blue line represents an original MDCT coefficient, and a red line represents an MDCT coefficient encoded/decoded by the conventional method. A yellow line represents an MDCT coefficient encoded/decoded by the method of the present invention. Herein, N=0 in the first layer, and 10 pulses are encoded in the second layer. Thus, in the encoding/decoding method of the present invention, the second layer starts sinusoidal pulse coding or decoding from 7 kHz. As illustrated in FIG. 8, when compared to the conventional method, the encoding/decoding method of the present invention can better represent a signal having a higher energy in a lower frequency band that may exert a great influence on the quality of an audio signal.

Figure 9:
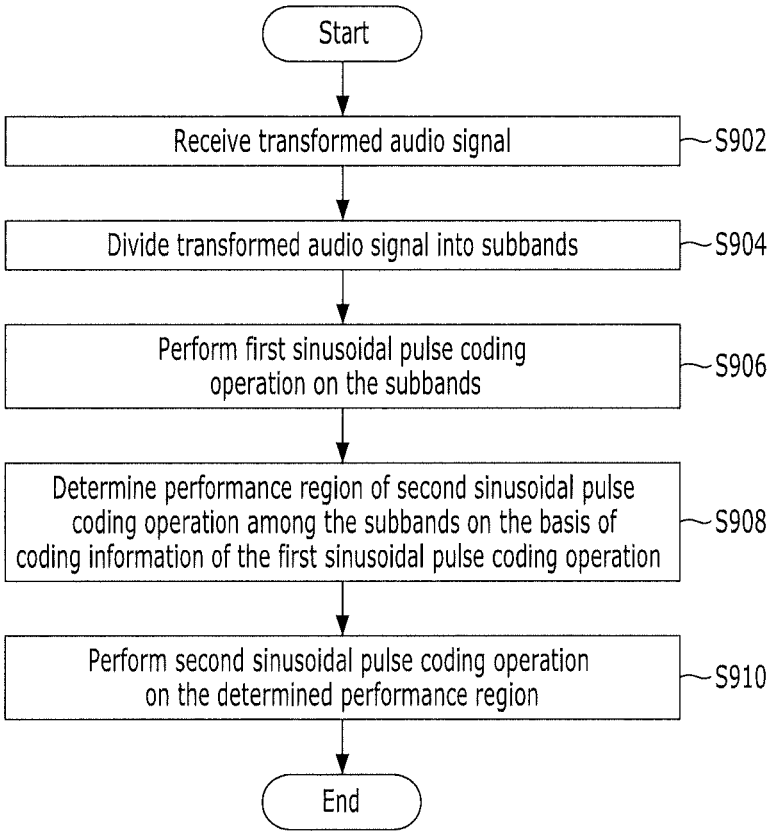
FIG. 9 is a flow diagram illustrating an audio signal encoding method in accordance with an embodiment of the present invention.

FIG. 9 is a flow diagram illustrating an audio signal encoding method in accordance with an embodiment of the present invention.

Referring to FIG. 9, the audio signal encoding method receives a transformed audio signal, for example an MDCT coefficient at step S902. The audio signal encoding method divides the transformed audio signal into a plurality of subbands at step S904.

The audio signal encoding method performs a first sinusoidal pulse coding operation on the subbands at step S906. The audio signal encoding method performs the first sinusoidal pulse coding operation variably according to coding information. Herein, the coding information may be information about the number of bits allocated for the first sinusoidal pulse coding operation, or information about the number of pulses allocated for the first sinusoidal pulse coding operation. Also, performing the first sinusoidal pulse coding operation variably may mean performing the first sinusoidal pulse coding operation while varying the number of bits or the number of pulses, or may mean performing the first sinusoidal pulse coding operation in the order of the energy of each subband, not in the order of the frequency band.

The audio signal encoding method determines a performance region of a second sinusoidal pulse coding operation among the subbands on the basis of coding information of the first sinusoidal pulse coding operation at step S908. In an exemplary embodiment, the audio signal encoding method determines a lower band of the subbands as the performance region of the second sinusoidal pulse coding operation if the coding information is smaller than a predetermined value, and determines an upper band of the subbands as the performance region of the second sinusoidal pulse coding operation if the coding information is greater than or equal to the predetermined value. In another exemplary embodiment, the audio signal encoding method starts applying the second sinusoidal pulse coding operation, from the lowest frequency band to which the first sinusoidal pulse coding operation is not applied. The audio signal encoding method performs the second sinusoidal pulse coding operation on the determined performance region at step S910.

Figure 10:
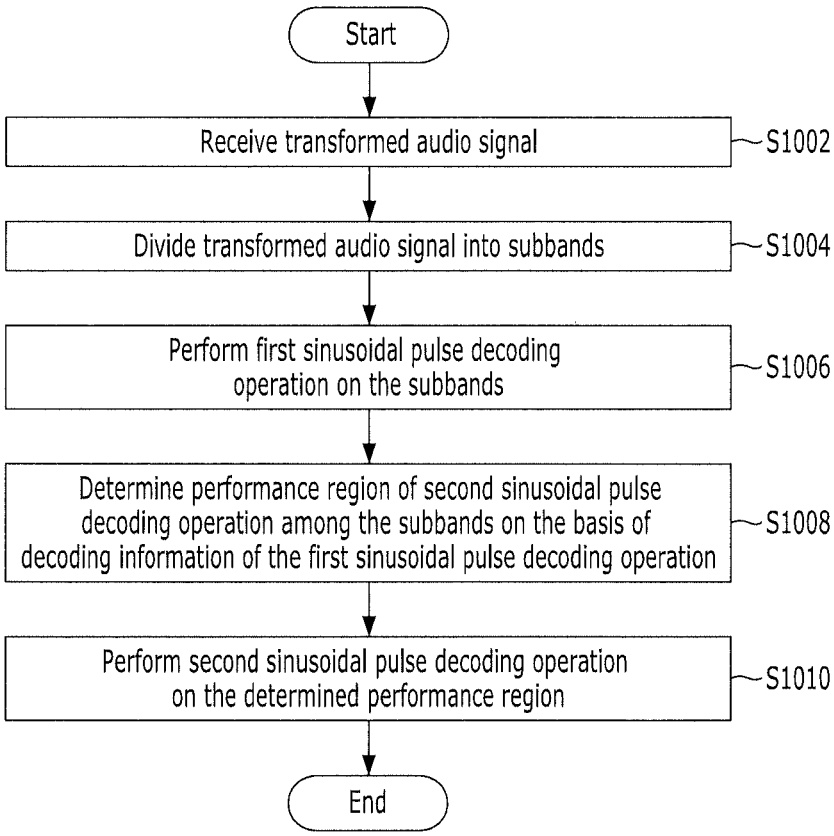
FIG. 10 is a flow diagram illustrating an audio signal decoding method in accordance with an embodiment of the present invention.

FIG. 10 is a flow diagram illustrating an audio signal decoding method in accordance with an embodiment of the present invention.

Referring to FIG. 10, the audio signal decoding method receives a transformed audio signal, for example an MDCT coefficient at step S1002. The audio signal decoding method divides the transformed audio signal into a plurality of subbands at step S1004.

The audio signal decoding method performs a first sinusoidal pulse coding operation on the subbands at step S1006. The audio signal decoding method performs the first sinusoidal pulse coding operation variably according to coding information. Herein, the coding information may be information about the number of bits allocated for the first sinusoidal pulse coding operation, or information about the number of pulses allocated for the first sinusoidal pulse coding operation. Also, performing the first sinusoidal pulse coding operation variably may mean performing the first sinusoidal pulse coding operation while varying the number of bits or the number of pulses, or may mean performing the first sinusoidal pulse coding operation in the order of the energy of each subband, not in the order of the frequency band.

The audio signal decoding method determines a performance region of a second sinusoidal pulse coding operation among the subbands on the basis of coding information of the first sinusoidal pulse coding operation at step S1008. In an exemplary embodiment, the audio signal decoding method determines a lower band of the subbands as the performance region of the second sinusoidal pulse coding operation if the coding information is smaller than a predetermined value, and determines an upper band of the subbands as the performance region of the second sinusoidal pulse coding operation if the coding information is greater than or equal to the predetermined value. In another exemplary embodiment, the audio signal decoding method starts applying the second sinusoidal pulse coding operation, from the lowest frequency band to which the first sinusoidal pulse coding operation is not applied. The audio signal decoding method performs the second sinusoidal pulse coding operation on the determined performance region at step S1010.

Hereinafter, an audio signal encoding/decoding method and apparatus in accordance with another embodiment of the present invention will be described with reference to FIGS. 11 and 12.

Figure 11:
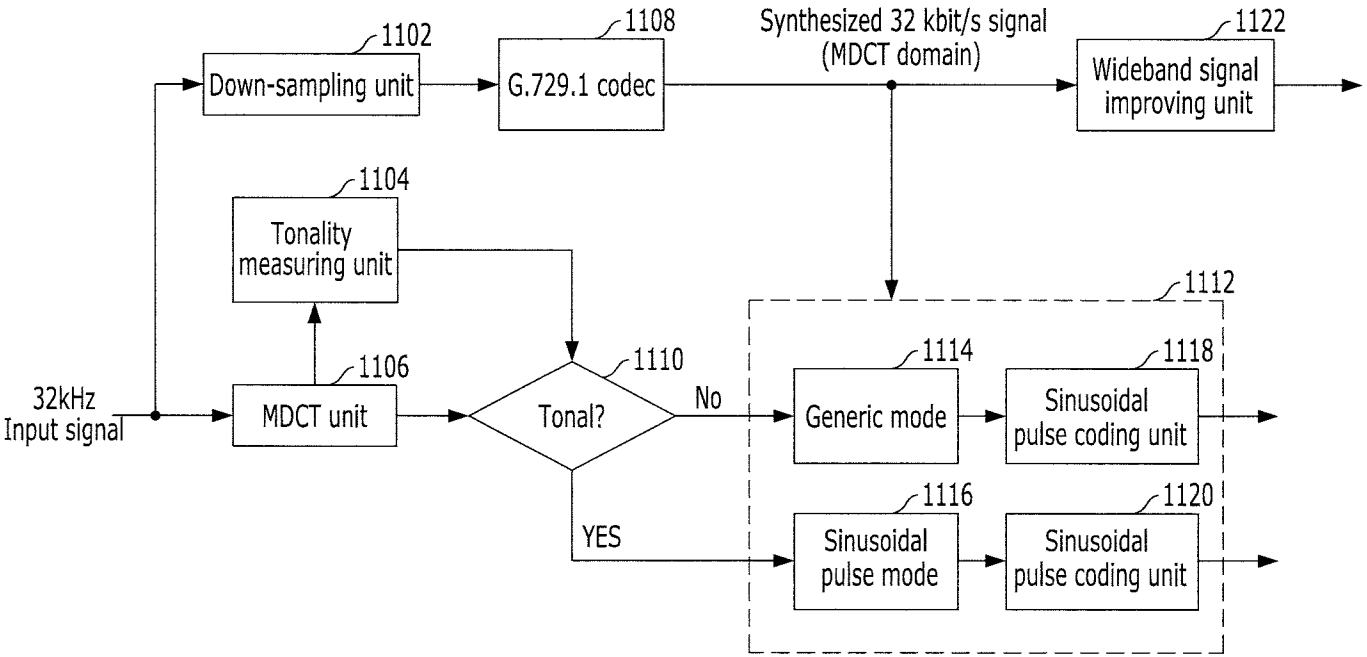
FIG. 11 is a block diagram of an audio signal encoding apparatus in accordance with another embodiment of the present invention.

FIG. 11 is a block diagram of an audio signal encoding apparatus in accordance with another embodiment of the present invention.

Referring to FIG. 11, an audio signal encoding apparatus receives a 32 kHz input signal and synthesizes a wideband signal and a super-wideband signal prior to output. The audio signal encoding apparatus includes a wideband extension coding module (1102, 1108 and 1122) and a super-wideband extension coding module (1104, 1106, 1110 and 1112). The wideband extension coding module, that is, a G.729.1 core codec operates based on a 16 kHz signal, whereas the super-wideband extension coding module operates based on a 32 kHz signal. Super-wideband extension coding is performed in an MDCT domain. Two modes, that is, a generic mode 1114 and a sinusoidal pulse mode 1116 are used to encode the first layer of the super-wideband extension coding module. Whether to use the generic mode 1114 or the sinusoidal pulse mode 1116 is determined on the basis of the measured tonality of an input signal. The upper super-wideband layers are encoded by a sinusoidal pulse coding unit (1118 and 1120) for improving the quality of high-frequency contents, or by a wideband signal improving unit 1122 for improving the perceptual quality of wideband contents.

The 32 kHz input signal is inputted to the down-sampling unit 1102 and is down-sampled to 16 kHz. The down-sampled 16 kHz signal is inputted to the G.729.1 codec 1108. The G.729.1 codec 1108 performs a wideband coding operation on the 16 kHz input signal. The synthesized 32 kbit/s signal outputted from the G.729.1 codec 1108 is inputted to the wideband signal improving unit 1122, and the wideband signal improving unit 1122 improves the quality of the input signal.

Meanwhile, the 32 kHz input signal is inputted to the MDCT unit 1106 and is transformed into an MDCT domain. The input signal transformed into an MDCT domain is inputted to the tonality measuring unit 1104 and it is determined whether the input signal is tonal (1110). That is, the coding mode of the first super-wideband layer is defined on the basis of tonality measurement performed by comparing the logarithmic domain energies of the previous frame and the current frame of the input signal in the MDCT domain. The tonality measurement is based on the correlation analysis between the spectral peaks of the previous frame and the current frame of the input signal.

On the basis of the tonality information outputted from the tonality measuring unit, it is determined whether the input signal is tonal (1110). For example, if the tonality information is greater than a threshold value, the input signal is determined to be tonal; and if not, the input signal is determined not to be tonal. The tonality information is also included in a bit stream transferred to a decoder. If the input signal is a tonal, the sinusoidal pulse mode 1116 is used; and if not, the generic mode 1114 is used.

The generic mode 1114 is used when the frame of the input signal is not tonal (tonal=0). The generic mode 1114 uses a coded MDCT-domain representation of the G.729.1 wideband extension codec 1108 to encode high frequencies. The high-frequency band (7-14 kHz) is divided into four subbands, and the selected similarity criteria for each subband are searched from the coded envelope-normalized wideband contents. In order to obtain a synthesized high-frequency content, the most similar match is scaled by two scaling factors, that is, the first scaling factor of a linear domain and the second scaling factor of a logarithmic domain. This content is improved by the additional pulses in the sinusoidal pulse coding unit 1118 and the generic mode 1114.

The generic mode 1114 may improve the quality of a coded signal by the audio encoding method of the present invention. For example, a bit budget allows to add two pulses in the first 4 kbit/s super-wideband layer. The start position of a track for searching the pulses to be added is selected on the basis of the subband energy of a synthesized high-frequency signal. The energy of the synthesized subbands may be expressed as Equation 1 below.

$$SbE(k) = \sum_{n=0}^{n=31} \ddot{M}_{32}(k \times 32 + n)^2 \quad k = 0, \ldots, 7 \qquad \text{Eq. 1}$$

where k denotes a subband index, SbE(k) denotes the energy of the $k^{th}$ subband, and $\ddot{M}_{32}(k)$ denotes a synthesized high-frequency signal.

Each subband includes 32 MDCT coefficients. The subband with a higher energy is selected as a search track of sinusoidal pulse coding. For example, the search track may include 32 positions with a unit size of 1. In this case, the search track corresponds to the subband.

Each of two pulse amplitudes is quantized by a 4-bit one-dimensional code book.

The sinusoidal pulse mode 1116 is used when the input signal is tonal. In the sinusoidal pulse mode 1116, for a high-frequency signal, the total number of additional pulses is 10, wherein 4 pulses may be in the 7000-8600 Hz frequency range, another 4 pulses may be in the 8600-10200 Hz frequency range, 1 pulse may be in the 10200-11800 Hz frequency range, and the other pulse may be in the 11800-12600 Hz frequency range.

The sinusoidal pulse coding unit (1118 and 1120) improves the quality of a signal outputted by the generic mode 1114 or by the sinusoidal pulse mode 1116. The number 'Nsin' of pulses added by the sinusoidal pulse coding unit (1118 and 1120) varies according to a bit budget. The tracks for sinusoidal pulse coding of the sinusoidal pulse coding unit (1118 and 1120) are selected on the basis of the subband energy of a synthesized high-frequency content.

For example, the synthesized high-frequency content in the 7000-13400 Hz frequency range is divided into eight subbands. Each subband includes 32 MDCT coefficients, and the energy of each subband may be calculated as Equation 1.

The tracks for sinusoidal pulse coding are selected by searching an Nsin/Nsin_track number of higher-energy subbands. Herein, Nsin_track is the number of pulses per track and is set to 2. Each of the selected Nsin/Nsin_track subbands corresponds to a track used for sinusoidal pulse coding. For example, Nsin is 4, first two pulses are located in the subband with the highest subband energy, and the other two pulses are located in the subband with the second highest energy. The positions of tracks for sinusoidal pulse coding vary on a frame-by-frame basis according to the available bit budget and high-frequency signal energy characteristics.

Meanwhile, another 20 pulses are added to a high-frequency signal in two stages. The track structure of the added pulses differs between the generic mode frame and the sinusoidal pulse mode frame.

In the generic mode frame, the start position of tracks for sinusoidal pulse coding depends on 'Nsin'. If Nsin is smaller than a threshold value, the pulses are located in a lower portion of the frequency domain of a high-frequency signal; and if Nsin is greater than or equal to the threshold value, most of the pulses are located in an upper portion of the frequency domain of a high-frequency signal. In this embodiment, the threshold value is defined as '8'.

In the first stage, ten pulses are added to a high-frequency spectrum in the following manner. First, six pulses are grouped into three tracks, each of which has two pulses and is located in a 7000-9400 Hz or 9750-12150 Hz frequency band. The next four pulses are grouped into two tracks, each of which has two pulses and is located in a 9400-11000 Hz or 12150-13750 Hz frequency band.

In the second stage, the other ten pulses are added in the following manner. First, six pulses are grouped into three tracks, each of which has two pulses and is located in a 7800-10200 Hz, 9400-11800 Hz or 8600-11000 Hz frequency band. The last four pulses are grouped into two tracks, each of which has two pulses and is located in a 10200-11800 Hz, 11800-13400 Hz or 11000-12600 Hz frequency band.

Table 1 shows an exemplary structure of a sinusoidal pulse track in the generic mode, that is, the track length, the step size, and the start position of the sinusoidal pulse track.

TABLE 1

| Nsin | First Start Position | Second Start Position | Step Size | Length |
|---|---|---|---|---|
| 0, 2 | 280 | 312 | 3 | 32 |
| | 376 | 408 | 2 | 32 |

TABLE 1-continued

| Nsin | First Start Position | Second Start Position | Step Size | Length |
|---|---|---|---|---|
| 4, 6 | 280 | 376 | 3 | 32 |
| | 376 | 472 | 2 | 32 |
| 8, 10 | 390 | 344 | 3 | 32 |
| | 486 | 440 | 2 | 32 |

In the sinusoidal pulse mode, the first ten pulses are added to in the following manner. First, six pulses are grouped into three tracks, each of which has two pulses and is located in a 7000-9400 Hz frequency band. The next four pulses are grouped into two tracks, each of which has two pulses and is located in an 11000-12600 Hz frequency band.

The second ten pulses are added to in the following manner. First, four pulses are grouped into two tracks, each of which has two pulses and is located in a 9400-11000 Hz frequency band. The next six pulses are grouped into three tracks, each of which has two pulses and is located in an 11000-13400 Hz frequency band.

Table 2 shows an exemplary structure of a sinusoidal pulse track of the first ten pulses in the sinusoidal pulse mode, that is, the track length, the step size, and the start position of each sinusoidal pulse track. Table 3 shows an exemplary structure of a sinusoidal pulse track of the second ten pulses in the sinusoidal pulse mode, that is, the track length, the step size, and the start position of each sinusoidal pulse track.

TABLE 2

| Track | Number of Pulses | Start Position | Step Size | Length |
|---|---|---|---|---|
| 0 | 2 | 280 | 3 | 32 |
| 1 | 2 | 281 | 3 | 32 |
| 2 | 2 | 282 | 3 | 32 |
| 3 | 2 | 440 | 2 | 32 |
| 4 | 2 | 441 | 2 | 32 |

TABLE 3

| Track | Number of Pulses | Start Position | Step Size | Length |
|---|---|---|---|---|
| 0 | 2 | 376 | 2 | 32 |
| 1 | 2 | 377 | 2 | 32 |
| 2 | 2 | 440 | 3 | 32 |
| 3 | 2 | 441 | 3 | 32 |
| 4 | 2 | 442 | 3 | 32 |

Figure 12:
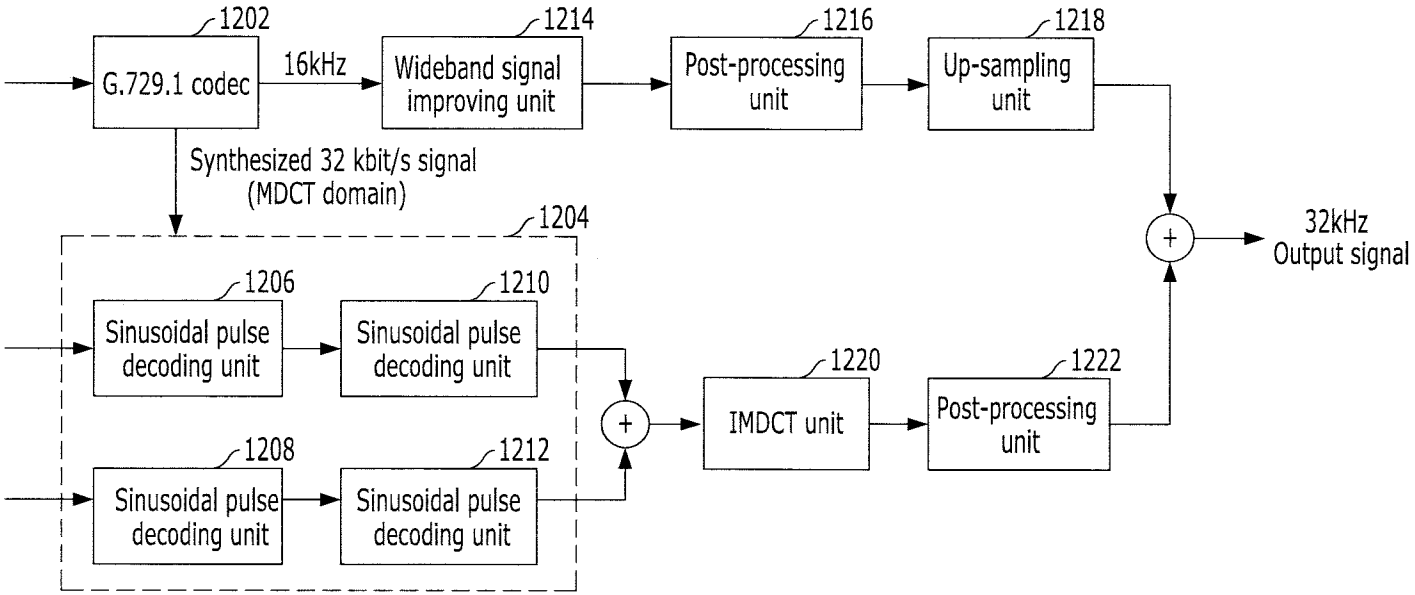
FIG. 12 is a block diagram of an audio signal decoding apparatus in accordance with another embodiment of the present invention.

FIG. 12 is a block diagram of an audio signal decoding apparatus in accordance with another embodiment of the present invention.

Referring to FIG. 12, an audio signal encoding apparatus receives a super-wideband signal and a wideband signal encoded by an encoding device, and outputs the same as a 32 kHz signal. The audio signal encoding apparatus includes a wideband extension coding module (1202, 1214, 1216 and 1218) and a super-wideband extension coding module (1204, 1220 and 1222). The wideband extension coding module decodes a 16 kHz input signal, and the super-wideband extension coding module decodes high-frequency signals to provide a 32 kHz output. Super-wideband extension coding is performed in an MDCT domain. Most of the super-wideband extension coding is performed in an MDCT domain. Two modes, that is, a generic mode 1206 and a sinusoidal pulse mode 1208 are used to decode the first layer of the extension coding module, which depends on a tonality indicator that is first decoded. The second layer uses the same bit allocation as an encoder in order to provide a wideband signal improvement and distribute bits among additional sinusoidal pulses. The third super-wideband layer includes a sinusoidal pulse coding unit (1210 and 1212) to improve the quality of high-frequency contents. The fourth and fifth extension layers provide a wideband signal improvement. Time-domain post-processing is used to improve synthesized super-wideband contents.

A signal encoded by an encoding device is inputted to the G.729.1 codec 1202. The G.729.1 codec 1202 outputs a 16 kHz synthesized signal to the wideband signal improving unit 1214. The wideband signal improving unit 1214 improves the quality of an input signal. The output signal of the wideband signal improving unit 1214 is post-processed by the post-processing unit 1216, and the resulting signal is up-sampled by the up-sampling unit 1218.

Meanwhile, it is necessary to synthesize wideband signals before high-frequency decoding. This synthesis is performed by the G.729.1 codec 1202. In high-frequency signal decoding, 32 kbit/s wideband synthesis is used before applying a general post-processing function.

High-frequency signal decoding is initiated by obtaining a synthesized MDCT-domain representation from the G.729.1 wideband decoding. MDCT-domain wideband contents are needed to decode a high-frequency signal of a generic coding frame. Herein, the high-frequency signal is constructed through an adaptive replication of a coded subband from a wideband frequency range.

The generic mode 1206 constructs a high-frequency signal by an adaptive subband replication. Also, two sinusoidal pulse components are added to the spectrum of the first 4 kbit/s super-wideband extension layer. The generic mode 1206 and the sinusoidal pulse mode 1208 use similar enhancement layers based on a sinusoidal pulse decoding scheme.

In the generic mode 1206, the quality of a decoded signal may be improved by the audio decoding method of the present invention. The generic mode 1206 adds two sinusoidal pulse components to the reconstructed entire high-frequency spectrum. These pulses are represented in position, code and size. Herein, the start position of a track for addition of the pulses is obtained from the index of a subband having a relatively high energy.

In the sinusoidal pulse mode 1208, a high-frequency signal is generated by a finite number of sinusoidal pulse component sets. For example, the total number of additional pulses is 10, wherein 4 pulses may be in the 7000-8600 Hz frequency range, another 4 pulses may be in the 8600-10200 Hz frequency range, 1 pulse may be in the 10200-11800 Hz frequency range, and the other pulse may be in the 11800-12600 Hz frequency range.

The sinusoidal pulse decoding unit (1210 and 1212) improves the quality of a signal outputted by the generic mode 1206 or by the sinusoidal pulse mode 1208. The first super-wideband enhancement layer further adds ten sinusoidal pulse components to the high-frequency signal spectrum of a sinusoidal pulse mode frame. In the generic mode frame, the number of additional sinusoidal pulse components is set according to adaptive bit allocation between a low-frequency improvement and a high-frequency improvement.

A decoding operation of the sinusoidal pulse decoding unit (1210 and 1212) is performed in the following manner. First, the position of a pulse is obtained from a bit stream. Then, the bit stream is decoded to obtain transmitted code indexes and size code book indexes.

The tracks for sinusoidal pulse decoding are selected by searching an Nsin/Nsin_track number of higher-energy sub-bands. Herein, Nsin_track is the number of pulses per track and is set to 2. Each of the selected Nsin/Nsin_track subbands corresponds to a track used for sinusoidal pulse decoding.

First, the position indexes of ten pulses related to the corresponding tracks are obtained from a bit stream. Then, the codes of ten pulses are decoded. Finally, the sizes of pulses (three 8-bit code book indexes) are decoded.

Meanwhile, in the decoding operation, another 20 pulses are added to a high-frequency signal to improve a signal quality. The addition of another 20 pulses has already been described above in detail, and thus a detailed description thereof will be omitted for conciseness.

The signals improved by the sinusoidal pulse decoding units 1210 and 1212 are inverse-MDCT-processed by the IMDCT 1220, and the resulting signals are post-processed by the post-processing unit 1222. The output signal of the up-sampling unit 1218 and the output signal of the post-processing unit 1222 are added to output a 32 kHz output signal.

While the present invention has been described with respect to the specific embodiments, it will be apparent to those skilled in the art that various changes and modifications may be made without departing from the spirit and scope of the invention as defined in the following claims.

The invention claimed is:

1. A method for encoding an audio signal, comprising:
receiving a transformed audio signal;
dividing the transformed audio signal into a plurality of sub-bands;
performing a first sinusoidal coding operation on the sub-bands;
determining tracks for a second sinusoidal coding operation among the sub-bands based on coding information of the first sinusoidal coding operation; and
performing the second sinusoidal coding operation on the tracks,
wherein starting positions of the tracks are depended according to the coding information.

2. The method of claim 1, wherein the coding information includes information about the number of bits allocated for the first sinusoidal coding operation, or information about the number of pulses allocated for the first sinusoidal coding operation.

3. The method of claim 1, wherein the starting positions of the
tracks are placed in a lower band of the sub-bands when the coding information is smaller than a predetermined value, and
are placed in an upper band of the sub-bands when the coding information is greater than or equal to the predetermined value.

4. An apparatus for encoding an audio signal, comprising:
a processor;
an input unit running on the processor and configured to receive a transformed audio signal;
an operation unit configured to divide the transformed audio signal into a plurality of sub-bands;
a first sinusoidal coding unit configured to perform a first sinusoidal coding operation on the sub-bands; and
a second sinusoidal coding unit configured to determine tracks for a second sinusoidal coding operation among the sub-bands based on coding information of the first sinusoidal coding operation, perform the second sinusoidal coding operation on the tracks,
wherein starting positions of the tracks are depended according to the coding information.

5. The apparatus of claim 4, wherein the coding information includes information about the number of bits allocated for the first sinusoidal coding operation, or information about the number of pulses allocated for the first sinusoidal coding operation.

6. The apparatus of claim 4, wherein the starting positions of the tracks are placed in a lower band of the sub-bands when the coding information is smaller than a predetermined value, and are placed in an upper band of the sub-bands when the coding information is greater than or equal to the predetermined value.

7. A method for decoding an audio signal, comprising:
receiving a transformed audio signal;
dividing the transformed audio signal into a plurality of sub-bands;
performing a first sinusoidal decoding operation on the sub-bands;
determining tracks for a second sinusoidal decoding operation among the sub-bands based on decoding information of the first sinusoidal decoding operation; and
performing the second sinusoidal decoding operation on the tracks,
wherein starting positions of the tracks are depended according to the decoding information.

8. The method of claim 7, wherein the decoding information includes information about the number of bits allocated for the first sinusoidal decoding operation, or information about the number of pulses allocated for the first sinusoidal decoding operation.

9. The method of claim 7, wherein the starting positions of the
tracks are placed in a lower band of the sub-bands when the decoding information is smaller than a predetermined value, and
are placed in an upper band of the sub-bands when the decoding information is greater than or equal to the predetermined value.

10. An apparatus for decoding an audio signal, comprising:
a processor;
an input unit running on the processor and configured to receive a transformed audio signal;
an operation unit configured to divide the transformed audio signal into a plurality of sub-bands;
a first sinusoidal decoding unit configured to perform a first sinusoidal decoding operation on the sub-bands; and
a second sinusoidal decoding unit configured to determine tracks for a second sinusoidal decoding operation among the sub-bands based on decoding information of the first sinusoidal decoding operation, and perform the second sinusoidal decoding operation on the tracks,
wherein starting positions of the tracks are depended according to the decoding information.

11. The apparatus of claim 10, wherein the decoding information includes information about the number of bits allocated for the first sinusoidal decoding operation, or information about the number of pulses allocated for the first sinusoidal decoding operation.

12. The apparatus of claim 10, wherein the starting positions of the tracks are placed in a lower band of the sub-bands when the decoding information is smaller than a predetermined value, and are placed in an upper band of the sub-bands when the decoding information is greater than or equal to the predetermined value.

* * * * *